US008607588B2

(12) United States Patent
Oh

(10) Patent No.: US 8,607,588 B2
(45) Date of Patent: Dec. 17, 2013

(54) REFRIGERATOR AND REFRIGERATOR DRAWER

(75) Inventor: Kyong-Sok Oh, Changwon (KR)

(73) Assignee: LG Electronics Inc., Seoul (KR)

( * ) Notice: Subject to any disclaimer, the term of this patent is extended or adjusted under 35 U.S.C. 154(b) by 509 days.

(21) Appl. No.: 12/673,457

(22) PCT Filed: Sep. 10, 2008

(86) PCT No.: PCT/KR2008/005353
§ 371 (c)(1),
(2), (4) Date: May 26, 2011

(87) PCT Pub. No.: WO2009/035267
PCT Pub. Date: Mar. 19, 2009

(65) Prior Publication Data

US 2011/0219808 A1 Sep. 15, 2011

(30) Foreign Application Priority Data

Sep. 13, 2007 (KR) ..... 10-2007-0093329

(51) Int. Cl.
*F25D 25/00* (2006.01)

(52) U.S. Cl.
USPC ..... 62/465

(58) Field of Classification Search
USPC ..... 62/465, 378, 381, 382, 259.1; 312/334.12, 334.1, 334.8, 334.9, 312/334.16, 404, 330.1
See application file for complete search history.

(56) References Cited

U.S. PATENT DOCUMENTS

| | | | | |
|---|---|---|---|---|
| 6,478,393 | B2 * | 11/2002 | Kim et al. | 312/334.12 |
| 6,484,512 | B1 * | 11/2002 | Anderson et al. | 62/3.2 |
| 7,104,621 | B2 * | 9/2006 | Choi | 312/296 |
| 7,159,415 | B2 * | 1/2007 | Wood | 62/441 |
| 7,296,863 | B2 * | 11/2007 | Lam et al. | 312/334.6 |
| 7,712,852 | B2 * | 5/2010 | Choi et al. | 312/402 |
| 8,403,437 | B2 * | 3/2013 | Bergmann et al. | 312/404 |

FOREIGN PATENT DOCUMENTS

| | | | |
|---|---|---|---|
| JP | 05-203339 | A | 8/1993 |
| JP | 2004-092938 | A | 3/2004 |
| KR | 20-1998-0060560 | Y1 | 11/1998 |

* cited by examiner

*Primary Examiner* — Mohammad M Ali
(74) *Attorney, Agent, or Firm* — Birch, Stewart, Kolasch & Birch, LLP

(57) ABSTRACT

Disclosed is a refrigerator comprising a main body provided with a freezing chamber and a refrigerating chamber; a receiving member provided to be able to be drawn in and out to the main body and receiving foods; fixing members disposed on right and left sides of the receiving member and supporting the receiving members; entrance guide members provided between the receiving member and the fixing members and guiding sliding movement of the receiving members; and shaking prevention members provided on right and left sides of the receiving members and preventing a right and left shaking phenomenon of the receiving members. With the present invention, a shaking phenomenon is prevented in drawing in and out a receiving member, so convenience of use may thereby be improved.

11 Claims, 2 Drawing Sheets

REFRIGERATOR AND REFRIGERATOR DRAWER

TECHNICAL FIELD

The present invention relates to a refrigerator and a refrigerator drawer.

BACKGROUND ART

Generally, a refrigerator is a device for storing foods at low temperature, and can freeze or refrigerate the foods according to a state of the foods to be stored.

The inside of the refrigerator is cooled by cold air continuously supplied, and the cold air is continuously generated by heat exchange functions of refrigerant that repeatedly performs a refrigeration cycle including compression-condensation-expansion-evaporation.

The cold air supplied to the inside of the refrigerator is evenly transferred to the inside of the refrigerator by convection, so the foods inside the refrigerator may be stored at a desired temperature.

The demand for large and multi-functional refrigerators according to diversification in user preferences and change in dietary life has been grown. Products having diverse forms have thereby been released.

A refrigerator may be divided into a type in which a freezing chamber is provided at an upper side of a refrigerating chamber, a type in which a freezing chamber is provided at a lower side of a refrigerating chamber, and a type in which a freezing chamber and a refrigerating chamber are provided to be adjacent to left and right each other according to a position of the refrigerating chamber and the freezing chamber.

Generally, a bottom freezer type refrigerator wherein the freezing chamber is provided at a lower side of the refrigerating chamber is formed with a plurality of drawer type storage spaces. The drawer type storage spaces are able to be drawn in and out forward and backward by having individual rail members or roller members.

However, the conventional refrigerator has the following problem.

In the case of the drawer type storage spaces constituted by roller members, the drawer type storage spaces may be shaken right and left, when the widths of the drawer type storage spaces do not correspond to the width of a main body of the refrigerator. When a user draws in and out the drawer type storage spaces, the drawers may not be properly drawn out due to a right and left shaking phenomenon, causing inconvenience to the user in using the drawer type storage spaces.

DISCLOSURE OF INVENTION

Technical Problem

It is an object of the present invention to provide a refrigerator that can prevent a right and left shaking phenomenon of receiving members by shaking prevention members provided between the receiving members and fixing members, when drawing in and out the receiving members.

It is another object of the present invention to provide a refrigerator drawer that can prevent a right and left shaking phenomenon of receiving members by shaking prevention members provided between the receiving members and fixing members, when drawing in and out the receiving members.

Technical Solution

In order to accomplish the objects of the present invention, a refrigerator according to an exemplary embodiment of the present invention comprises: a main body provided with a freezing chamber and a refrigerating chamber; a receiving member provided to be able to be drawn in and out to the main body and receiving foods; fixing members disposed on right and left sides of the receiving member and supporting the receiving members; entrance guide members provided between the receiving member and the fixing members and guiding sliding movement of the receiving members; and shaking prevention members provided on light and left sides of the receiving members and preventing a right and left shaking phenomenon of the receiving members.

A refrigerator according to another exemplary embodiment of the present invention comprises: a main body; a receiving member provided to be able to be drawn in and out to an inside of the main body and receiving foods; fixing members provided in an inner side of the main body and supporting the both sides of the receiving member; a first roller mounted on the receiving member and performing a rolling motion along the fixing member when drawing in and out the receiving member; a second roller mounted on the fixing member and performing a rolling motion along the receiving member when drawing in and out the receiving member; and shaking prevention members provided between the receiving member and the fixing members and performing a rolling motion by contacting the receiving member or the fixing members when drawing in and out the receiving member to prevent a right and left shaking phenomenon of the receiving member.

A refrigerator drawer according to another exemplary embodiment of the present invention comprises: a receiving member provided to be able to be slidingly drawn in and out to an inside of the refrigerator; entrance guide members provided on one side of the receiving member and performing a rolling motion when drawing in and out the receiving member; fixing members provided on sides of the receiving member and supporting the receiving member; and shaking prevention members provided between the receiving member and the fixing members and restricting lateral shaking of the receiving member by contacting the receiving member and the fixing members, respectively, when drawing in and out the receiving member.

Advantageous Effects

With the exemplary embodiments of the present invention, a receiving member is not shaken right and left but is slidingly drawn in and out by entrance guide members rotating in a direction that intersect with each other and a plurality of rollers constituting shaking prevention members.

The receiving member is thereby easily drawn in and out, improving convenience of use of a refrigerator.

A first shaking prevention roller performs a rolling motion on a side of a fixing member and a second shaking prevention roller performs a rolling motion on a side of the receiving member, so the receiving member is thereby easily drawn in and out, making it possible to draw in and out the receiving member with simple operations despite receiving heavy things.

The receiving member is slidingly drawn in and out by the plurality of rollers, the life span of the roller is extended, improving the reliability of a product.

In particular, in the case of a receiving member having a long width in the right and left thereof, the receiving member is highly likely to be shaken right and left when being slidingly drawn in and out, but is restricted laterally by the shaking prevention members. The sliding drawing in and out of the receiving member is smoothed even more forward and backward. Therefore, the performance of the drawing in and out of the receiving member is improved.

MODE FOR THE INVENTION

Hereinafter, the exemplary embodiments of the present invention will be described in detail with reference to the accompanying drawings. However, the present invention is not limited to the present embodiments but may be easily implemented as other embodiments included within the scope of the present invention by adding, modifying or deleting other constituents.

Figure 1:
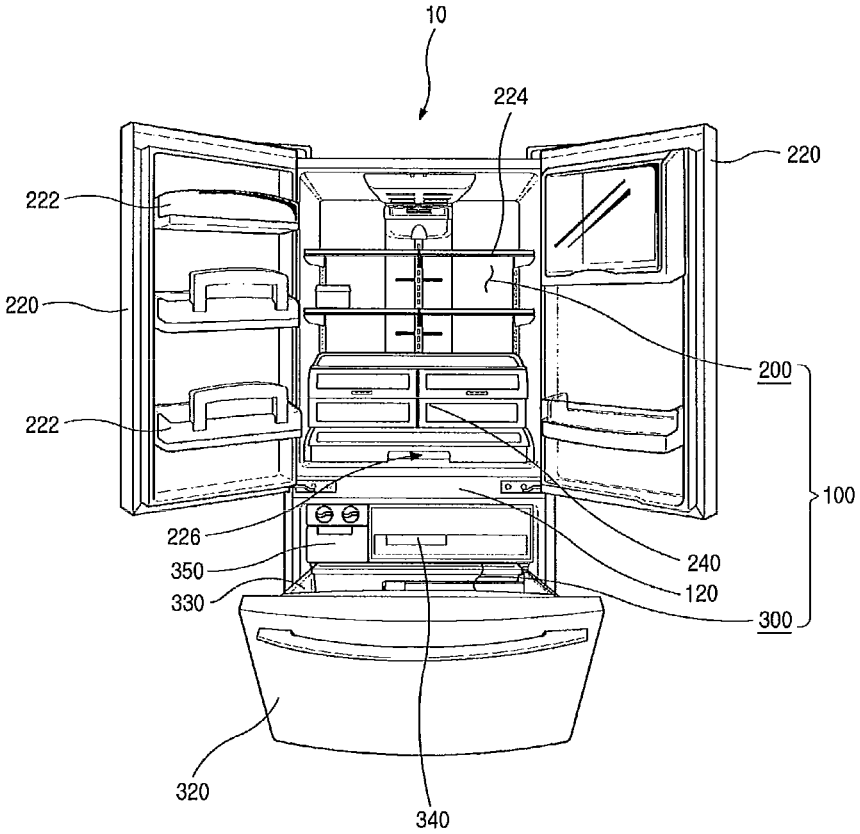
FIG. 1 is a front view showing an inside of a refrigerator according to the present invention.

FIG. 1 is a front view showing an inside of a refrigerator according to the present invention.

Referring to FIG. 1, a refrigerator 10 according to the present invention is formed in an approximate rectangular parallelepiped shape. The exterior of the refrigerator 10 is formed by comprising a main body 100 provided with a refrigerating chamber 200 and a freezing chamber 300 that are storage spaces, a refrigerating door 220 selectively shielding the refrigerating chamber 200, and a freezing chamber door 320 selectively shielding the freezing chamber 300.

The main body 100 is partitioned into a upper side and a lower side by a barrier 120, wherein the refrigerating chamber 200 for refrigerating foods is provided at the upper side and the freezing chamber 300 for freezing foods is provided at the lower side, making it possible to store foods according to purposes of use and storage methods.

The front surface of the freezing chamber 300 is open or closed as a freezing chamber door 320 moves forward or backward, and a main basket 330 is provided in a rear side of the freezing chamber door 320.

The main basket 330 is communicated with the freezing chamber door 320, the main basket 330 is also drawn out forward when the freezing chamber door 320 is drawn out forward.

A sub basket 340 receiving relatively small foods is provided on an upper side of the main basket 330. The sub basket 340 can be slidingly drawn in and out from the freezing chamber 300.

An ice-maker 350 generating ice is provided on a left side of the sub basket 340.

The front surface of the refrigerating chamber 200 provided on the upper side of the freezing chamber 340 is shielded by the freezing chamber door 220 rotatably mounted in one direction, preventing cold air from discharging from the refrigerator.

The other surface of the refrigerating chamber door 220 may be provided with a plurality of refrigerating chamber baskets 222 storing foods such as beverage or water, and the front surface of the refrigerating chamber door 220 may also be provided with a dispenser capable of taking out ice or water without opening the refrigerating chamber door 220.

A plurality of shelves 224 are provided inside the refrigerating chamber 200. The plurality of shelves 224 partition the inside of the refrigerator up and down to form one or more spaces and are mounted in order that rear ends of the shelves 224 are fixed to fixing grooves formed on a rear wall surface of the refrigerator. The installation height of the shelves 224 may be adjusted by a user. One shelf 224 may partition the entirety of the refrigerator up and down or right and left, so the inside of the refrigerator may be diversified.

An internal space of the refrigerating chamber 200 may be partitioned by the plurality of refrigerating shelves 224 as well as may be partitioned by one or more drawers 226. A plurality of drawers 26 may be provided inside the refrigerating chamber 200 or the freezing chamber 300, and the shapes thereof may also be diversified according to the sorts of storage foods.

Hereinafter, a drawer having a long length in the right and left thereof from among the plurality of drawers will be described by way of example.

The drawer 226 is for storing pizza or foods having a long length, whose horizontal length corresponds to the width of the inside of the refrigerator, and is slidingly drawn in and out. The drawer 226 is provided on the most bottom side within the refrigerator in order that the drawer 26 can be slidingly drawing in and out in a stable state.

Figure 2:
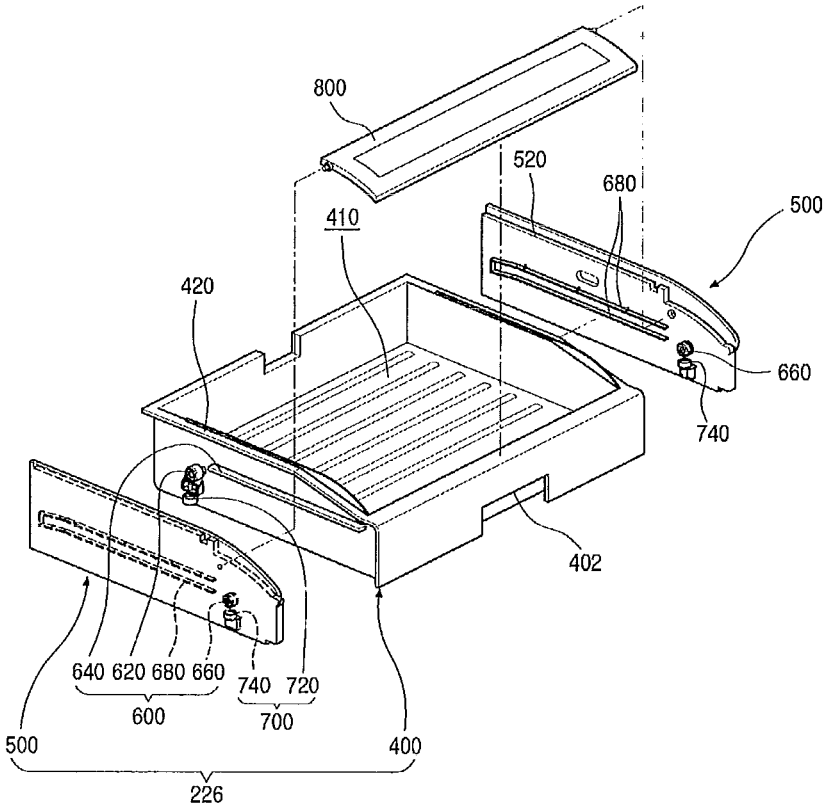
FIG. 2 is a perspective view showing a state that a receiving member is isolated from fixing members, which are principal constitutions of a refrigerator according to the present invention.
Figure 3:
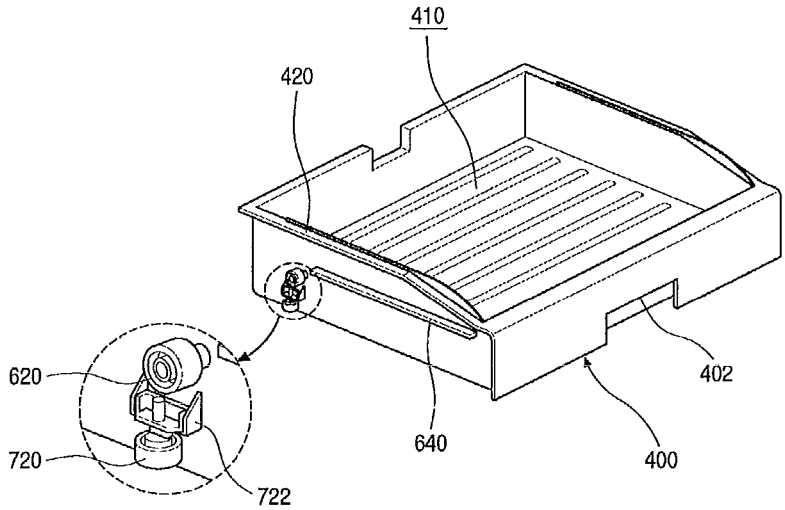
FIG. 3 is a perspective view showing a side of a receiving member, which is a principal constitution of a refrigerator according to the present invention.
Figure 4:
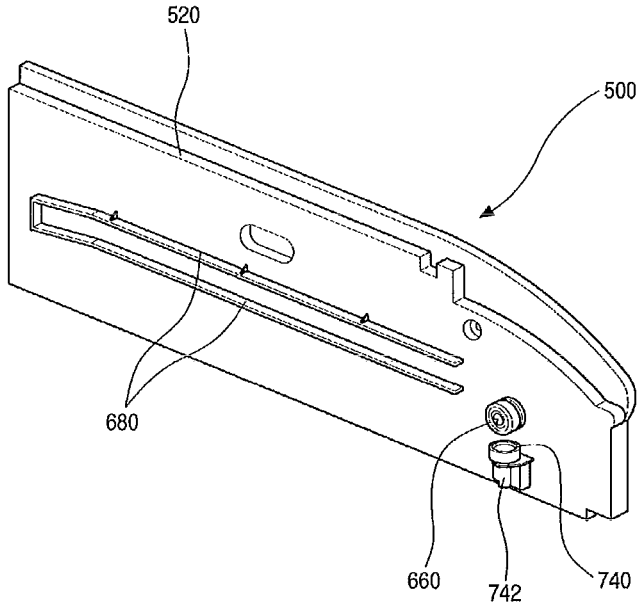
FIG. 4 is a perspective view showing a shape of a fixing member, which is a principal constitution of a refrigerator according to the present invention.

FIG. 2 is a perspective view showing a state that a receiving member is isolated from fixing members, which are principal constitutions of a refrigerator according to the present invention, FIG. 3 is a perspective view showing a side of a receiving member, which is a principal constitution of a refrigerator according to the present invention, and FIG. 4 is a perspective view showing a shape of a fixing member, which is a principal constitution of a refrigerator according to the present invention.

Referring to FIGS. 2 to 4, the drawer comprises a receiving member 400 forming a receiving space, fixing members 500 fixing the receiving member 400 on right and left sides of the receiving member 400, and a cover member 800 rotatably mounted on the fixing members 500 and being open and closed by being communicated with the receiving member 400 when drawing in and out the receiving member 400.

The receiving member 400 comprises a storage part 410 forming a space where foods are received, and supporting parts 420 laterally protruded from upper ends of both sides of the storage part 410.

The storage part 410 has size corresponding to a right and left width of the inside of the main body 100 so as to store foods having a relatively long length or having a large size, and forms a storage space whose upper side is open by edges upwardly extended along borders. A handle 402 held by a user is formed on a front surface center of to storage part 410.

The upper ends of both sides of the storage part 410 is formed with supporting parts 420 seated on upper surface supporting parts 520 of the fixing member 500 that is to be explained later to support both sides of the receiving member 400. The supporting part 420 protrudes so as to be seated on the upper surface supporting part 520, wherein the supporting part 420 may be formed in a shape to correspond to the upper surface supporting part 520.

Both sides of the storage part 410, that is, the bottom sides of the supporting part 420, are formed with first rollers 620 and guides 640, which are one constitution of an entrance guide member 500 allowing the receiving member 400 to be slidingly entered.

The first rollers 620 are formed on rear ends of both sides of the receiving member 400, whose center axes are fixed perpendicular to the sides of the receiving member 400 in order that the receiving member 400 can be slidingly entered along moving path parts 680, which is another constitution of the entrance guide member 600 that is to be described later. Therefore, the first roller 620 performs a rolling motion along one surface of the moving path part 680 and the receiving member 400 is thus slidingly drawn in and out.

Meanwhile, a guide 640 guiding a movement of a second roller 660, which is another constitution of an entrance guide member 600 that is to be described later, protrudes forward the first roller 620. The guide 640 protrudes at a predetermined thickness and height and guides the movement of the second roller 660 to allow the receiving member 400 to be slidingly drawn in and out forward and backward.

A first shaking prevention roller 720, which is one constitution of a shaking prevention member 700 preventing a right and left shaking of the receiving member 400, is provided on the bottom side of the first roller 620.

The first shaking prevention roller 720 is spaced and fixed from the side of the receiving member 400 at a predetermined interval by a bracket 722. The bracket 722 has an approximate 'U' shape and protrudes from the side of the receiving member 400 at a predetermined height.

The center axis of the first shaking prevention roller 720 is fixed perpendicular to the bottom surface of the bracket 722, that is, parallel to the side of the receiving member 400, so the first shaking prevention roller 720 is mounted so as to perform a rolling motion along the side of the fixing member 500.

When the receiving member 400 is drawn in and out forward and backward, the first shaking prevention roller 720 thus performs a rolling motion along an inner side of the fixing member 500, so the receiving member 400 is not shaken right and left but is easily entered forward and backward.

Meanwhile, fixing members 500 are provided between the receiving member 400 and a main body 100. The fixing members 500 are fixed to both wall sides of the main body 100, that is, the inner wall sides of the refrigerating chamber 200, by engagement members such as screws.

The fixing member 500 is formed of rectangular plate whose front end is approximately rounded, and an upper surface supporting part 520 interfered with the supporting member 420 to support the receiving member 400 is formed on the upper end of the fixing member 500.

The upper surface supporting part 520 is spaced downward at a predetermined interval on the upper end of the fixing member 500 to protrude into the inner side of the refrigerating chamber 200. In other words, the upper surface supporting part 520 has a step from the upper end of the fixing member 500 and is interfered with the supporting part 420, thereby supporting the weight of the receiving member 400.

Front ends of the fixing members 500, that is, the front ends of the bottoms of the upper surface supporting parts 520, are formed with second rollers 660 that is another constitution of entrance guide members 600 allowing the receiving member 400 to be slidingly entered by operating with the guides 640. The center axis of the second roller 660 is fixed perpendicular to the side of the fixing member 500 and the second roller 660 perform a rolling motion along one surface of to guide 640, so the receiving member 400 is slidingly entered.

A moving path part 680 guiding a movement of the first roller 620 protrudes backward the second roller 660. The moving path part 680, which is the last constitution of the entrance guide member 600, protrudes at a predetermined thickness and height and guides the movement of the first roller 620 to allow the receiving member 400 to be slidingly drawn in and out forward and backward.

A second shaking prevention roller 740, which is another constitution of a shaking prevention member 700 preventing a right and left shaking of the receiving member 400, is provided on the bottom side of the second roller 660.

The second shaking prevention roller 740 is spaced and fixed from the side of the receiving member 400 at a predetermined interval by a holder 742. The holder 742 has an approximate '∩' shape and protrudes from the side of the receiving member 400 at a predetermined height.

The center axis of the second shaking prevention roller 740 is fixed perpendicular to the upper surface of the holder 742, that is, parallel to the side of the fixing member 500, so the second shaking prevention roller 740 is mounted so as to perform a rolling motion along the side of the receiving member 400.

When the receiving member 400 is drawn in and out forward and backward, the second shaking prevention roller 720 thus performs a rolling motion along both sides of the receiving member 400, so the receiving member 400 is not shaken right and left but is easily entered forward and backward.

Meanwhile, a cover member is mounted on the fixing members 500. The cover member 800, which shields a portion of the receiving member 400 when the receiving member 400 is inserted, is axis-coupled to the fixing members 500 to be rotatably mounted.

When the receiving member 400 is inserted, both right and left ends and front end of the cover member 800 overlap with both right and left ends and front end of the corresponding receiving member 400. When the receiving member 400 is drawn out, the both ends of the cover member relatively moves along both ends of the receiving member 400 and rotates, thereby making it possible to open a portion of a receiving space of the cover member 800.

Hereinafter, the operations of the present invention constituted as described above will be described with reference to FIGS. 1 to 4.

When drawing out a receiving member 400, the receiving member 400 is drawn out forward in a state when a handle 402 is held. At this time, the receiving member 400 is drawn out forward by operations of an entrance guide member 600 and a shaking prevention member 700.

More specifically, a first roller 620 positioned on a rear end of the receiving member 400 performs a rolling motion forward along a moving path part 680, a second roller 660 positioned on a front end of a fixing member 500, that is, a front end of the receiving member 400, performs a rolling motion along a guide 640, a first shaking prevention roller 720 performs a rolling motion along a side of the fixing member 500, a second shaking prevention roller 740 performs a rolling motion along a side of the receiving member 400, and the receiving member 400 is not shaken right and left but is slidingly drawn out forward.

In other words, the receiving member 400 is not shaken right and left but is slidingly drawn out forward by the interoperation between the first roller 620 and the first shaking prevention roller 720, and between the second roller 660 and the second shaking prevention roller 740, fixed to intersect with each other, respectively.

More specifically, the right and left shaking of the receiving member 400 is prevented by the operations between the first shaking prevention roller 720 provided on the front side of the receiving member 400 and the second shaking prevention roller 740 provided on the rear side of the fixing member 600, and the receiving member 400 is slidingly drawn out with ease by the operation between the first roller 720 provided on the side of the receiving member 400 and the second roller 660 provided on the fixing member 500, so convenience of use is improved.

In contrast, when drawing in a receiving member 400, the receiving member 400 is drawn in backward in a state when a handle 402 is held. At this time, the receiving member 400 is drawn in backward by operations of an entrance guide member 600 and a shaking prevention member 700.

More specifically, a first roller 620 positioned on a rear end of the receiving member 400 performs a rolling motion backward along a moving path part 680, a second roller 660 positioned on a front end of a fixing member 500, that is, a front end of the receiving member 400, performs a rolling motion along a guide 640, a first shaking prevention roller 720 performs a rolling motion along a side of the fixing member 500, a second shaking prevention roller 740 performs a rolling motion along a side of the receiving member 400, and the receiving member 400 is not shaken right and left but is slidingly drawn in backward.

In other words, the receiving member 400 is not shaken right and left but is slidingly drawn in backward by the interoperation between the first roller 620 and the first shaking prevention roller 720, and between the second roller 660 and the second shaking prevention roller 740, fixed to intersect with each other, respectively.

More specifically, the right and left shaking of the receiving member 400 is prevented by the operations between the first shaking prevention roller 720 provided on the front side of the receiving member 400 and the second shaking prevention roller 740 provided on the rear side of the fixing member 600, and the receiving member 400 is slidingly drawn in with ease by the operation between the first roller 720 provided on the side of the receiving member 400 and the second roller 660 provided on the fixing member 500, so convenience of use is improved.

Although the exemplary embodiments of the present invention are described, it will be apparent to those skilled in the art that various modifications and variations can be made in the present invention without departing from the spirit or scope of the inventions.

For example, in the aforementioned exemplary embodiments of the present invention, a shaking prevention member 700 includes a first shaking prevention roller 720 and a second prevention roller 740. However, it will be apparent that if the shaking prevention member 700 includes any one of the first shaking prevention roller 720 and the second prevention roller 740, this will also come within the scope of the technical spirit of the present invention.

In the aforementioned exemplary embodiments of the present invention, the shaking prevention members 700 are formed on both right and left sides of a receiving member 400. However, it will be apparent that if the shaking prevention members 700 are provided on a bottom surface of the receiving member 400 or a bottom surface within a refrigerator to allow the receiving member 400 to be slidingly drawn in and out, this will also come within the scope of the technical spirit of the present invention.

INDUSTRIAL APPLICABILITY

With the exemplary embodiments of the present invention, a sliding drawing in and out of a receiving member can be smoothed as an entrance guide member performs a rolling motion, and the smooth drawing in and out as well as the right and left shaking of the receiving member can be prevented as shaking prevention members perform a rolling motion by contacting sides of the receiving member or sides of fixing members, so convenience of use is improved to have very high industrial applicability.

The invention claimed is:

1. A refrigerator, comprising:

a main body provided with a freezing chamber and a refrigerating chamber;

a receiving member provided to be able to be drawn in and out to the main body and receiving foods;

fixing members disposed on right and left sides of the receiving member and supporting the receiving member;

entrance guide rollers provided between the receiving member and the fixing members and guiding sliding movement of the receiving member; and shaking prevention rollers provided between the receiving member and the fixing members and preventing a right and left shaking phenomenon of the receiving member, wherein rotating axes of the entrance guide rollers are orthogonal to rotating axes of the shaking prevention rollers.

2. The refrigerator as claimed in claim 1, wherein the shaking prevention rollers are disposed on the receiving member or one of the fixing members and perform a rolling motion by contacting the sides of the corresponding fixing member or receiving member.

3. The refrigerator as claimed in claim 1, wherein the shaking prevention rollers comprise:

first shaking prevention rollers provided on both right and left side walls of the receiving member and performing a rolling motion along an inner side of the fixing member; and second shaking prevention rollers provided on inner sides of the fixing members on right and left sides of the inside of the main body and performing a rolling motion along side walls of the receiving member.

4. The refrigerator as claimed in claim 1, wherein the shaking prevention rollers are disposed downward to the entrance guide rollers and perform a rolling motion by contacting the receiving member or one of the fixing members.

5. The refrigerator as claimed in claim 1, further comprising:

brackets extending perpendicularly from one surface of the receiving member or one of the fixing members, wherein the rotating axes of the shaking prevention rollers penetrate perpendicularly through the brackets, and the shaking prevention rollers are rotatably mounted on one end of the rotating axis and perform a rolling motion by contacting the side of the receiving member or one of the fixing members.

6. The refrigerator as claimed in claim 1, wherein an outer side end of the shaking prevention rollers is more outward than an outer side end of the entrance guide rollers.

7. A refrigerator, comprising:

a main body;

a receiving member provided to be able to be drawn in and out to an inside of the main body and receiving foods;

fixing members provided in an inner side of the main body and supporting both sides of the receiving member;

a first roller mounted on the receiving member and performing a rolling motion along the fixing member when drawing in and out the receiving member;

a second roller mounted on the fixing member and performing a rolling motion along the receiving member when drawing in and out the receiving member;

first shaking prevention rollers provided on both right and left side walls of the receiving member and performing a rolling motion along an inner side of each of the fixing members; and second shaking prevention rollers provided on the inner sides of the fixing members on right and left sides of the inside of the main body and performing a rolling motion along side walls of the receiving member, wherein rotating axes of the first roller and the second roller are orthogonal to rotating axes of the first shaking prevention rollers and the second shaking prevention rollers, respectively.

8. The refrigerator as claimed in claim 7, wherein each of the fixing members further comprises a moving path unit guiding the drawing in and out of the receiving member by simultaneously contacting an upper portion and a lower portion of the first roller.

9. The refrigerator as claimed in claim 8, wherein the receiving member further comprises a guide guiding the drawing in and out of the receiving member in a state supported by contacting an upper portion of the second roller.

10. The refrigerator as claimed in claim 7, wherein the first shaking prevention rollers and second shaking prevention rollers are provided downward to the first roller and the second roller, respectively.

11. The refrigerator as claimed in claim 10, wherein the rotating axes of the first roller and second roller are disposed perpendicular to the side of the receiving member, and the rotating axes of the first shaking prevention rollers and second shaking prevention rollers are disposed to intersect with the axes of the first roller and second roller, respectively.

* * * * *